US006157030A

United States Patent [19]

Sakairi et al.

[11] Patent Number: 6,157,030

[45] Date of Patent: Dec. 5, 2000

[54] ION TRAP MASS SPECTROMETER

[75] Inventors: Minoru Sakairi, Tokorozawa; Tadao Mimura, Hitachinaka; Toshihiro Ishizuka, Hitachinaka; Masaru Tomioka, Hitachinaka; Yasuaki Takada, Kodaira; Takayuki Nabeshima, Kokubunji, all of Japan

[73] Assignee: Hitachi, Ltd., Tokyo, Japan

[21] Appl. No.: 09/143,398

[22] Filed: Aug. 28, 1998

[30] Foreign Application Priority Data

Sep. 1, 1997 [JP] Japan ..... 9-235760
Sep. 1, 1997 [JP] Japan ..... 9-235769

[51] Int. Cl.[7] ..... H01J 49/42

[52] U.S. Cl. ..... 250/292; 250/291; 250/290

[58] Field of Search ..... 250/292, 291, 250/290, 288, 281, 282

[56] References Cited

U.S. PATENT DOCUMENTS 5,572,022 11/1996 Schwartz et al. ..... 250/292
5,623,144 4/1997 Yoshinari et al. ..... 250/292
5,650,617 7/1997 Mordehai ..... 250/292
5,663,560 9/1997 Sakairi et al. ..... 250/288

*Primary Examiner*—Kiet T. Nguyen
*Attorney, Agent, or Firm*—Antonelli, Terry, Stout & Kraus, LLP

[57] ABSTRACT

Disclosed is an ion trap mass spectrometer improved to obtain a high sensitivity without the lowering of resolution. By fitting a mesh electrode to an aperture (an ion sampling aperture or an ion extracting aperture) made in endcap electrodes constituting an ion trap mass analysis region, a radio frequency electric field in the mass analysis region is not disturbed even if the diameter of the aperture is set to a large value to heighten ion transmission efficiency. By fitting a shield electrode for preventing collision of ions with an insulated ring constituting an outer wall of the mass analysis region, charging up of the insulated ring is prevented to improve stability of detection signals. Furthermore, by arranging a shield member for shielding stray charged particles detouring through the circumference of the mass analysis region to approach an ion detector, generation of noises based on these stray charged particles is prevented.

21 Claims, 15 Drawing Sheets

Sulfurdimethoxin (m.w.310)

ION TRAP MASS SPECTROMETER

BACKGROUND OF THE INVENTION

The present invention relates to an ion trap mass spectrometer, and in particular to an ion trap mass spectrometer making it possible to obtain a high sensitivity without the lowering of resolution.

As a conventional ion trap mass spectrometer, there can be mentioned a spectrometer disclosed in a literature: Analytical Chemistry 1990, Vol. 62, page 1284. In FIG. 14, a schematic structure of the ion trap mass spectrometer described in this literature is shown. In this spectrometer, an electrospray method, which is an ionizing method using an electrospray phenomenon, is used to ionize a sample solution. Ions generated by electrospray from the end of a capillary under atmospheric pressure are introduced through a differential pumping region to a vacuum region. Since the ions introduced into the differential pumping region are focused with a first electrostatic focusing lens disposed inside the differential pumping region, transmission efficiency of the ions through the differential pumping region is improved. The ions having passed through the differential pumping region are focused with a second electrostatic focusing lens, and then are introduced into an ion trap type mass analysis region 12 composed of a pair of endcap electrodes 11*a* and 11*b* in a bowl-like form and a doughnut type ring electrode 11*c*. The ions introduced into the mass spectrometer 12 are subjected to mass analysis by a radio frequency electric field generated by a radio frequency potential applied between the ring electrode 11*c* and the endcap electrodes 11*a*, 11*b*, and then are detected with an ion detector. Since in this ion trap mass spectrometer the ions are once trapped in the ion trap mass analysis region and subsequently mass analysis is carried out, the spectrometer has a characteristic that signal intensity becomes highly larger, in particular in measuring a mass spectrum.

As shown in FIG. 15, however, when the ions having passed through an aperture of a skimmer 5 are introduced into the ion trap mass analysis region 12 in the conventional spectrometer through a focusing lens 7 and a deflector, the ions are decelerated between the focusing lens 7 and the endcap electrode 11*a* to be defocused. Therefore, if the diameter of an ion sampling aperture 23 made in the endcap electrode 11*a* is small, for example, about 1 mm, transmission efficiency of the ions is lowered when the ions pass through the ion sampling aperture 23. To set the diameter of the ion sampling aperture 23 to a small value as described above is for the purpose of not disturbing the radio frequency electric field in the region surrounded by the endcap electrode 11*a* and the ring electrode 11*c* as much as possible. In other words, if the diameter of the ion sampling aperture 23 is made large, for example, about 3 mm to heighten the ion transmission efficiency in this place, disturbance of the radio frequency electric field in the ion trap mass analysis region 12 surrounded by the endcap electrodes 11*a* and 11*b* and the ring electrode 11*c* becomes intense, so that the peak of intensity of the ion gets broad, and resolution drops. This is the same as for an ion extracting aperture 24 made in the endcap electrode 11*b*. Namely, when the diameter of the ion extracting aperture 24 is large, the radio frequency electric field in the ion trap mass analysis region 12 is disturbed in the same manner as above, so that resolution drops. In FIG. 15, reference number 10 designates a gate electrode for controlling ion incidence into the ion trap mass analysis region 12; 13, an ion extraction lens for extracting mass-analyzed ions from the ion trap mass analysis region 12; 22*a* and 22*b*, insulated rings for maintaining insulation between the endcap electrodes 11*a* and 11*b*, and the ring electrode 11*c*; and 32, an ion detector for detecting ions extracted from the inside of the ion trap mass analysis region 12.

In the conventional spectrometer, for two purposes of filling the mass analysis region 12 with a buffer gas for trapping ions, and maintaining electric isolation between the endcap electrodes 11*a* and 11*b* and the ring electrode 11*c*, the insulated rings 22*a* and 22*b* made of quartz are arranged between the endcap electrodes 11*a* and 11*b*, and the ring electrode 11*c*, as shown in FIG. 15. Therefore, when a part of ions introduced through the ion sampling aperture 23 into the mass analysis region 12 collides with inner wall faces of the insulated rings 22*a* and 22*b*, the insulated rings 22*a* and 22*b* take a charge so that a trajectory of the ions in the mass analysis region 12 is disturbed by the charge. This results in a problem that detected ion intensity is remarkably reduced.

Furthermore, in the conventional spectrometer no measures are taken to meet a problem that as shown by an arrow in FIG. 15 a part of the ions and charged droplets having passed through the aperture of the skimmer 5 does not pass inside the mass analysis region 12 but passes through the outside thereof to reach the ion detector 32 so that noises are generated. In other words, when there are generated ions and charged droplets which make a detour through the outside of the mass analysis region 12 and then become stray in the vicinity of the ion detector 32, they are accelerated to the ion detector 32 and flow thereinto so that they are detected as random noises. Therefore, noises largely increases.

Furthermore, by the inventors' investigation, it has been found that, since a radio frequency potential is applied to the ring electrode 11*c* in ion trap type mass spectrometers if the stray ions and the like exist, they are accelerated by a leakage electric field as well which is generated by the application of the radio frequency potential, and the stray ions reach the detector 32. Consequently this type spectrometer has a more serious evil by the stray ions or the like than other type mass spectrometers.

SUMMARY OF THE INVENTION

The present invention has been made to overcome the problems in the conventional spectrometers, an object thereof is to provide an ion trap mass spectrometer with a high resolution so that a radio frequency electric field is not disturbed in an ion trap mass analysis region even if the diameter of an ion sampling aperture or an ion extracting aperture in the ion trap mass analysis region is considerably large.

Another object of the invention is to provide an ion trap mass spectrometer which is improved to prevent an insulated ring in an ion trap mass analysis region from being charged and which makes it possible to keep a high detection sensitivity stable over a long time.

Still another object of the invention is to provide an ion trap mass spectrometer with high analysis accuracy to prevent increase in noises caused by the stray ions or the like.

To attain the first object of the present invention, an electrode in a mesh form is fitted to at least one of apertures (an ion sampling aperture and an ion extracting aperture) made respectively in the pair of endcap electrodes in the ion trap analysis region.

More specifically, the first characteristic of the present invention as follows. An ion trap mass spectrometer comprises an ion source for generating ions of sample molecules under an atmospheric pressure; a vacuum region which is evacuated to make a sufficient vacuum; a differential pumping region disposed in the middle of a path for sampling the ions generated by means of the ion into the vacuum region; a focusing lens set inside the vacuum region for focusing the ions sampled into the vacuum region through the differential pumping region; a mass analysis region having a pair of endcap electrodes opposite to each other inside the vacuum region and a ring electrode arranged between the endcap electrodes, the mass analysis region being for mass-analyzing the ions focused by means of the focusing lens; and an ion detector for detecting the mass-analyzed ions by means of the mass analysis region. The ion trap mass spectrometer further comprises a conductive mesh electrode which is fitted to an end face at the side opposite to the ring electrode of at least one of apertures respectively made in the pair of the endcap electrodes.

If the diameter of these apertures is made large, for the purpose of increasing the transmission efficiency of the ions which pass through the apertures (the ion sampling aperture and the ion extracting aperture) which are respectively made in the pair of the endcap electrodes, the electric field in the mass analysis region is highly disturbed as described above, resulting in decrease in analysis accuracy. If, in particular, the diameter of the aperture (the ion sampling aperture) made in the endcap electrode positioned at the ion sampling side of the mass analysis region is made large, peaks of the detected ion intensity become broad because of the disturbance of the electric field in the mass analysis region, associated with the diameter being made large. Thus, resolution is lowered. In the present invention, however, the conductive mesh electrode is fitted to the end face, at the side opposite to the ring electrode, of the aperture (the ion sampling aperture) made in the endcap electrode arranged at the ion sampling side (at the side where the focusing lens and deflector are arranged) of the mass analysis region. Thus, the potential at the conductive mesh electrode is kept equal to that at the endcap electrode. Therefore, the disturbance of the electric field is effectively suppressed even if the diameter of the aperture made in the endcap electrode is large. This results in prevention of the decrease in resolution. Besides, the conductive mesh electrode has many fine openings, and consequently the influence on the passage of ions is very little. As a result, reduction in resolution is effectively prevented without any substantial drop in ion transmission.

The conductive mesh electrode may be fitted to the aperture (the ion extracting aperture) made in the endcap electrode positioned at the ion extracting side (the side of the ion detector) of the mass analysis region.

When the conductive mesh electrode is formed so that the openings are positioned on the central axis of the endcap electrode, the number of collision of the ions with the mesh electrode constituting member is reduced. Thus, decrease in ion transmisson efficiency (the amount of ions having passed) can be avoided, causing preferable result.

The mesh electrode can be fitted to the corresponding endcap electrode by fixing a cylindrical electrode on which a conductive mesh member is supported with an appropriate fixing means such as a screw. According to this, a more preferable result for practice can be obtained.

To attain the second object, a second characteristic of the present invention is that at the inside of an inner wall of at least one of a pair of insulated rings respectively disposed between the pair of the endcap electrodes and the ring electrode in the ion trap mass analysis region, a shield electrode for preventing ion collision with the insulated rings is arranged.

More specifically, the second characteristic of the present invention is as follows. An ion trap mass spectrometer comprises an ion source for generating ions of sample molecules under atmospheric pressure; a vacuum region which is evacuated to make a sufficient vacuum; a differential pumping region disposed in the middle of a path for sampling the ions generated by means of the ion into the vacuum region; a focusing lens set inside the vacuum region for focusing the ions sampled into the vacuum region through the differential pumping region; a mass analysis region having a pair of endcap electrodes opposite to each other inside the vacuum region and a ring electrode arranged between the endcap electrodes, the mass analysis region being for mass-analyzing the ions focused by means of the focusing lens; and an ion detector for detecting the mass-analyzed ions by means of the mass analysis region. A shield electrode is further arranged at the inside of an inner face of an insulated ring made of an insulating material and disposed between the pair of the endcap electrodes and the ring electrode. The shield member is for shielding charged particles flying and approaching the inner wall face of the insulated ring.

As described above, when charged particles such as ions are made incident on the inner wall face of the insulated ring disposed between the endcap electrode and the ring electrode in the mass analysis region, the insulated ring is charged so that the charge causes the ion trajectory in the mass analysis region to be disturbed. Thus, detected ion intensity sharply decreases. In the present invention, however, the shield electrode is arranged at the inside of the inner wall face of the insulated ring, so as to shield the charged particles such as ions, which is to be made incident on the insulated ring by means of the shield electrode. Therefore, the disturbance of the ion trajectory in the mass analysis region based on the charged insulated ring can be prevented, thereby preventing the sharp decrease in the detected ion intensity effectively.

The shield electrode can be arranged at the inside of the inner wall face of the insulated ring, oppositely to the face, and apart from the face at an appropriate distance. In this case, a more preferable result can be obtained by electrically connecting the shield electrode to the endcap electrode.

When the shield electrode is made into a ring form and it is arranged concentrically with the ion sampling aperture and the ion extracting aperture, a more preferable result for preventing charging up of the insulated ring can be obtained. To prevent discharge between the shield electrode electrically connected to the endcap electrode and the ring electrode, it is effective to make the end portion at the side opposite to the ring electrode of the shield electrode round.

The conductive mesh electrode and shield electrode can be used each independently, but they may be used together. Of course, by using the two together, each advantageous effect obtained in the case of using the endcap electrode and the shield electrode each independently can be simultaneously obtained.

Furthermore, to attain the third object of the present invention, a third characteristic of the present invention is to arrange a shield member for shielding the stray ions and charged particles (charged droplets and the like) detouring through the circumference of the ion trap mass analysis region to reach the ion detector, in the middle of their path.

More specifically, the third characteristic of the present invention is as follows. An ion trap mass spectrometer comprises an ion source for generating ions of sample molecules under atmospheric pressure; a vacuum region which is evacuated to make a sufficient vacuum; a differential pumping region disposed in the middle of a path for sampling the ions generated by means of the ion into the vacuum region; a focusing lens set inside the vacuum region for focusing the ions sampled into the vacuum region through the differential pumping region; a mass analysis region having a pair of endcap electrodes opposite to each other inside the vacuum region and a ring electrode arranged between the endcap electrodes, the mass analysis region being for mass-analyzing the ions focused by means of the focusing lens; and an ion detector for detecting the mass-analyzed ions by means of the mass analysis region. A shield member is further arranged in the middle of a path reaching the ion detector through the circumference of the mass analysis region in the vacuum region. The shield member is for shielding charged particles approaching the ion detector through the path.

The shield member can be arranged in at least one of the vicinities of the end portion at the ion extracting side (the ion detecting side) of the mass analysis region and the end portion at the ion sampling side (the focusing lens side) thereof, so as to block flying path of the stray ions and the like.

As described above, since a radio frequency potential is applied between the ring electrode and the endcap electrodes in the ion trap mass analysis region, the stray ions and the like are accelerated by a leakage electric field generated by the application of the radio frequency potential. Thus, an evil (generation of noises) based on the stray ions and the like is more remarkable than other type mass analysis regions. However, when the shield member is arranged in the vicinity of the end portion, for example, at the ion extracting side (the ion detector side) of the mass analysis region, the stray ions and the like collide with the shield member to become extinct even if the leakage electric field has an influence on the stray ions and the like. When the shield member is arranged in the vicinity of the end portion, for example, at the ion sampling side (the focusing lens side) of the mass analysis region, most of the stray ions and the like collide with the shield member to become extinct. According to the evil by the stray ion and the like becomes very little. Whether the shield member is arranged at the ion extracting side or the ion sampling side of the mass analysis region in such a manner as above, the charged particles, for example, the stray ions, which pass through the outside of the focusing lens and the mass analysis region cannot reach the ion detector. Thus, increase in the noises (random noises) is effectively suppressed. Of course, when the shield members are arranged at both of the ion extracting and sampling sides of the ion trap mass analysis region, a more remarkable advantage can be obtained.

A deflector for deflecting ions is arranged between the focusing lens and the mass analysis region inside the vacuum region. This deflector permits to prevent droplets not charged from flowing into the ion trap mass analysis region.

A plurality of the shield members may be arranged. Increase in the number of the arranged shield members is more effective for decrease in the stray ions and the like. However, it is desirable that at least one of the plural shield members is arranged in the vicinity of the end portion at the ion extracting side (the ion detector side) of the ion trap mass analysis region.

When a larger number of the shield members are additionally arranged along the outer wall face of the ion trap mass analysis region, the leakage electric field is shielded. Thus, this is more effective for blocking the evil caused by the stray ions and the like. The used shield member may be a member in a mesh form wherein many openings are made in a conductive plate. Such a conductive member in a mesh form can easily be made by applying chemical etching to a conductive plate using a mask. The shield member may be a member in a form of a baffle in which plural rectangular plate members are arranged. Such shield members may be made of various conductive materials such as stainless steel, titanium and copper.

The same advantage as above can be obtained when the method for ionizing the sample molecule in the sample solution under atmospheric pressure in the present invention, also be any atmospheric pressure ionization method such as an atmospheric pressure chemical ionization method using corona discharge, an atmospheric pressure spray method using thermally assisted nebulization a sonic spray ionization method using high-speed gas flow, instead of the electrospray method using an electrospray phenomenon described referring to FIG. 14. The same advantage can also be obtained when any plasma ionization method using inductively coupled plasma or microwave induced plasma is adopted.

The third characteristic of the present invention is the most effective, when an ion trap mass analysis region is used as the mass analysis region. The same advantages can be obtained, when it is used in a quadrupole mass spectrometer which carries out mass analysis using a radio frequency electric field generated between 4 rod electrodes. It is permissible that the ions having passed into the vacuum region from the differential pumping region through the skimmer are deflected with the deflector and then are introduced into the mass analysis region. However, the same advantage as those by the shield member can be obtained even if the ions are introduced without any deflection.

The mesh electrode used in the present invention may be, for example, an electrode having an ordinary mesh structure shown in FIG. 4(*a*), or an electrode having a mesh structure as shown in FIG. 4(*b*) or (*c*). The mesh electrodes having structures shown in FIGS. 4(*b*) and 4(*c*) are especially effective from the standpoint that a large opening is made in the central area, through which the central portion of an ion beam having a high ion current density passes. The electrode having the structure shown in FIG. 4(*a*) is somewhat unfavorable from the standpoint that a mesh constituting member is arranged at the central area of the mesh, as well, and ions collide with the area so that the amount of the passing ions is lowered. Such mesh electrodes can easily be made, for example, by forming many fine mesh openings in a conductive thin plate made of stainless steel or titanium by any chemical etching method using a well-known mask. The shape of the mesh opening portions may be various, but a honeycomb shape (an equilateral hexagon) or a circular shape as shown in FIGS. 4(*b*) and (*c*) is effective for passage of ions because the total area of the opening portions becomes large. When the size of the ion sampling aperture of the endcap electrode is set to about 3 mm, in a mesh having a circular central opening portion as shown in FIG. 4(*c*) the diameter of the central opening portion becomes about 1 mm. When the central opening portion is made circular, the area of the central opening portion can be made maximum.

The present invention can widely be applied to a liquid chromatograph mass spectrometer for separating sample components in a solution by a liquid chromatograph and then ionizing the separated sample components to mass-analyze them, or a capillary electrophoresis mass spectrometer for separating the sample components by using capillary electrophoresis and then mass-analyzing them, a plasma ion source mass spectrometer for ionizing the sample components in a solution by plasma to mass-analyze them, and the like.

Other objects, structures and advantageous effect obtained by them than those in the above description will be clear in detailed description referring to embodiments.

DETAILED DESCRIPTION OF THE PREFERRED EMBODIMENTS

Figure 1:
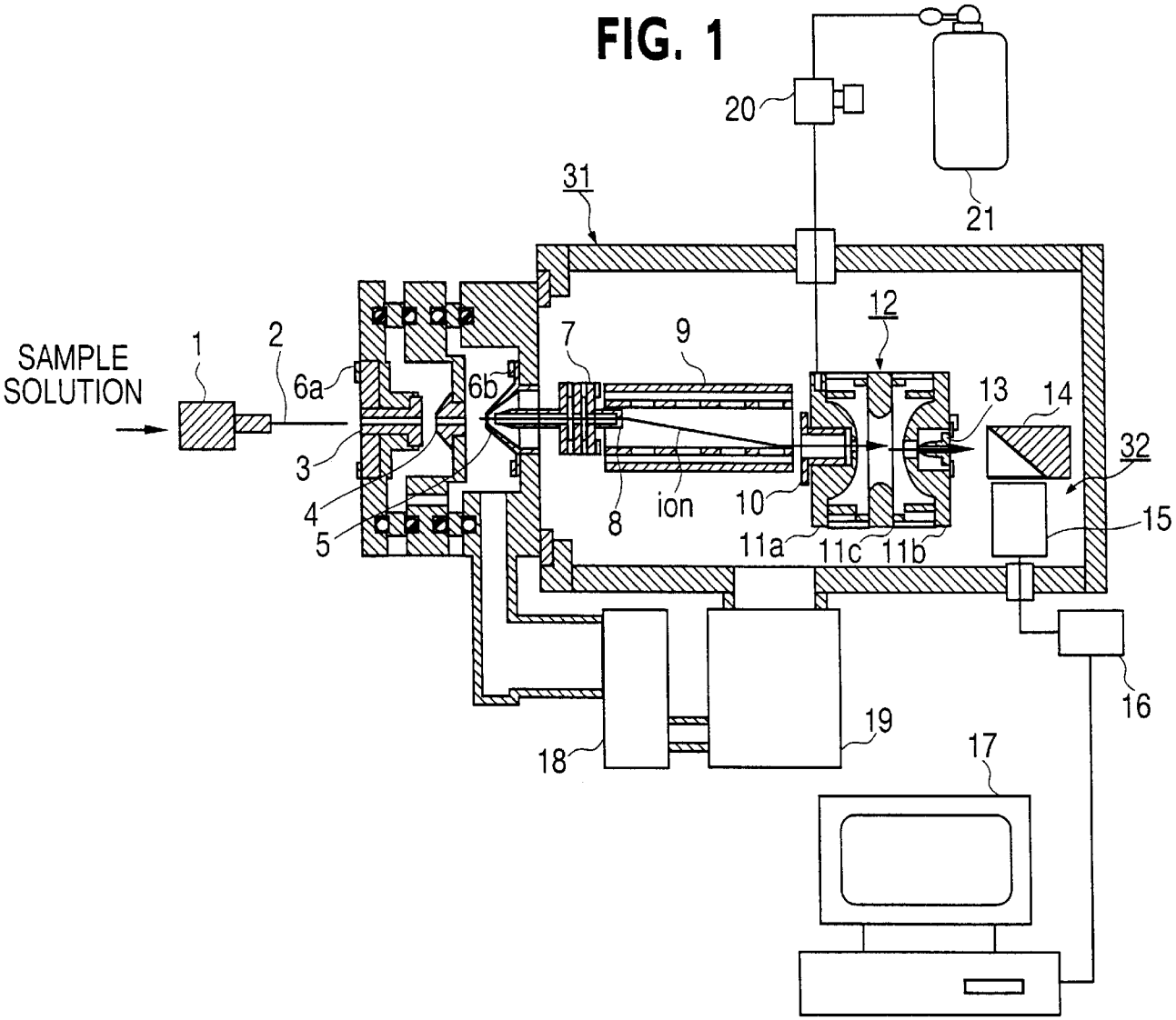
FIG. 1 is a view schematically showing a structure of an ion trap mass spectrometer according to a first embodiment of the present invention.

Referring to the drawings, embodiments of the present invention will be described in detail, hereinafter.

Embodiment 1

FIG. 1 is a view schematically showing a structure of an ion trap mass spectrometer according to a first embodiment of the present invention. The present embodiment is concerned with an ion trap mass spectrometer having an electrospray ion source. First, the structure and operation of this spectrometer will be described.

A sample solution supplied from a liquid chromatograph for separating a sample mixture, a syringe pump, or the like is forwarded into a capillary 2 provided with the electrospray ion source 1, and then nebulized from the end of the capillary 2 into a surrounding gas under atmospheric pressure. A high potential is applied to the capillary 2. The sample solution nebulized from the end of the capillary 2 by an electrospray phenomenon caused by the application of the high potential is charged, so as to generate charged particles (charged droplets). While the generated charged droplets pass in sequence through a first aperture 3, a second aperture 4 and a skimmer 5 in a differential pumping region heated by heaters 6*a* and 6*b* at a given temperature, the droplets are vaporized by heating or collision with neutral molecules so as to generate ions of the sample component. Potentials can be applied between the first aperture 3 and the second aperture 4, and between the second aperture 4 and the skimmer 5, respectively. By these applied potentials, ion transmisson efficiency is improved and simultaneously dissociation of cluster ions is attained by collision with remaining molecules. In the present embodiment, the differential pumping region is evacuated with a roughing vacuum pump 18 such as a rotary pump, a scroll pump, or a mechanical booster pump. However, a turbo molecular pump may be used.

The generated ions pass through the skimmer 5 and subsequently are introduced into a vacuum chamber 31. The ions are then focused by means of an electrostatic lens 7. In the present embodiment, an Einzel lens composed of a group of three electrodes is used as the electrostatic lens 7.

The ions focused with the electrostatic lens 7 pass through a slit 8, are deflected with a deflector 9 and then are introduced through a gate electrode 10 into an ion trap mass analysis region 12 composed of a pair of endcap electrodes 11*a* and 11*b* in a bowl-like form and a ring electrode 11*c*.

The spatial angle of parts introduced into the ion trap analysis region 12 among the jets containing the droplets and the like having flowed in the vacuum chamber 31 through the skimmer 5 is limited with the slit 8. Therefore, excessive droplets and the like are prevented from being introduced into the ion trap mass analysis region 12.

Besides, the ions having passed through the slit 8 are deflected with the deflector 9 and made incident, from the aperture (ion sampling aperture) of the endcap electrode 11*a*, onto the mass analysis region 12. At this time, the droplets and the like not charged are not deflected with the deflector 9. Thus, the droplets and the like which have passed through the skimmer 5 and are not charged are more effectively prevented from passing through the aperture of the endcap electrode 11*a* to be introduced into the ion trap mass analysis region. In the present embodiment, the ions are deflected by using a double cylindrical type deflector composed of an outer cylinder electrode and an inner cylinder electrode positioned inside it and having many openings, as the deflector 9, and using an electric field penetrating from the outer cylinder to the inside of the inner cylinder electrode through the openings of the inner cylinder electrode.

When the ion trapped inside the ion trap mass analysis region 12 are taken outwards from this region 12, a certain potential is applied to the gate electrode 10 arranged between the deflector 9 and the endcap electrode 11*a* so that introduction of the ions into the mass analysis region 12 is stopped.

The ions introduced into the ion trap mass analysis region 12 collide with gas such as helium introduced into the region 12 so that their trajectory is made small. Thereafter, the ions are extracted through the aperture (ion extracting aperture) of the endcap electrode 11*b* to the outside of the mass analysis region by changing (scanning) the amplitude of the radio frequency potential applied to the ring electrode 11*c*. Furthermore, the ions pass through an ion extracting lens 13 and are detected by means of an ion detector 32 composed of a conversion dynode 14 and a scintillation counter 15. In this case, the ions to be detected are first converted into electrons with the conversion dynode 14, and then the electrons are detected with the scintillation counter 15. The aforementioned gas such as helium is supplied from a cylinder 21 or the like which is a supply source of the gas through a regulator 20.

The detection signals obtained by the ion detector 32 are amplified with an amplifier 16 and then are forwarded to a data processing system 17. Usually, the relationship between a mass to charge ratio (m/e ratio) and ion intensity (mass spectrum), change over time in the ion intensity of the ion having a specific m/e ratio (mass chromatogram), and the like are displayed in a display device (for example, a CRT display) fitted to the data processing device 17.

From the inner space of the vacuum chamber 31 inside which the electrostatic lens 7, the slit 8, the deflector 9, the gate electrode 10, the mass analysis region 12 and the ion detector 32 are arranged, the gas therein is evacuated by means of a turbo molecule pump 19 to such an extent that a sufficient vacuum is made. For the turbo molecule pump 19, an auxiliary pump is necessary at its back pressure side. However, the same function may be attained by the roughing vacuum pump 18 used for evacuation of the differential pumping region. In the embodiment, for evacuation of the differential pumping region, a scroll pump having a pumping speed of about 900 liters/minute is used as the roughing vacuum pump 18, for evacuation of the vacuum chamber 31 the turbo molecule pump 19 having a pumping speed of about 200 liters/minute is used, and for the auxiliary pump for the turbo molecule pump 19, the roughing vacuum pump (scroll pump) 19 is also used. In such a manner, the vacuum system in an atmospheric pressure ionization mass spectrometer, which is liable to become complicated, can be made remarkably simple.

A problem occurring when actual analysis is carried out using the spectrometer shown in FIG. 1 is that the ions having passed through the lens 7 and the deflector 9 are decelerated and defocused before they reach the ion sampling aperture 23 of the endcap electrode 11*a* through the gate electrode 10, so that the amount of the ions which can pass through the ion sampling aperture 23 (ion transmisson efficiency) is reduced. When the diameter of the ion sampling aperture 23 is made large to improve the transmission efficiency in this place, bad influence (for example, disturbance of electric field distribution) is given on the radio frequency electric field in the ion trap mass analysis region 12 surrounded by the endcap electrodes 11*a* and 11*b* and the ring electrode 12. Thus, resolution of ion peak in measuring a mass spectrum deteriorates.

Figure 2:
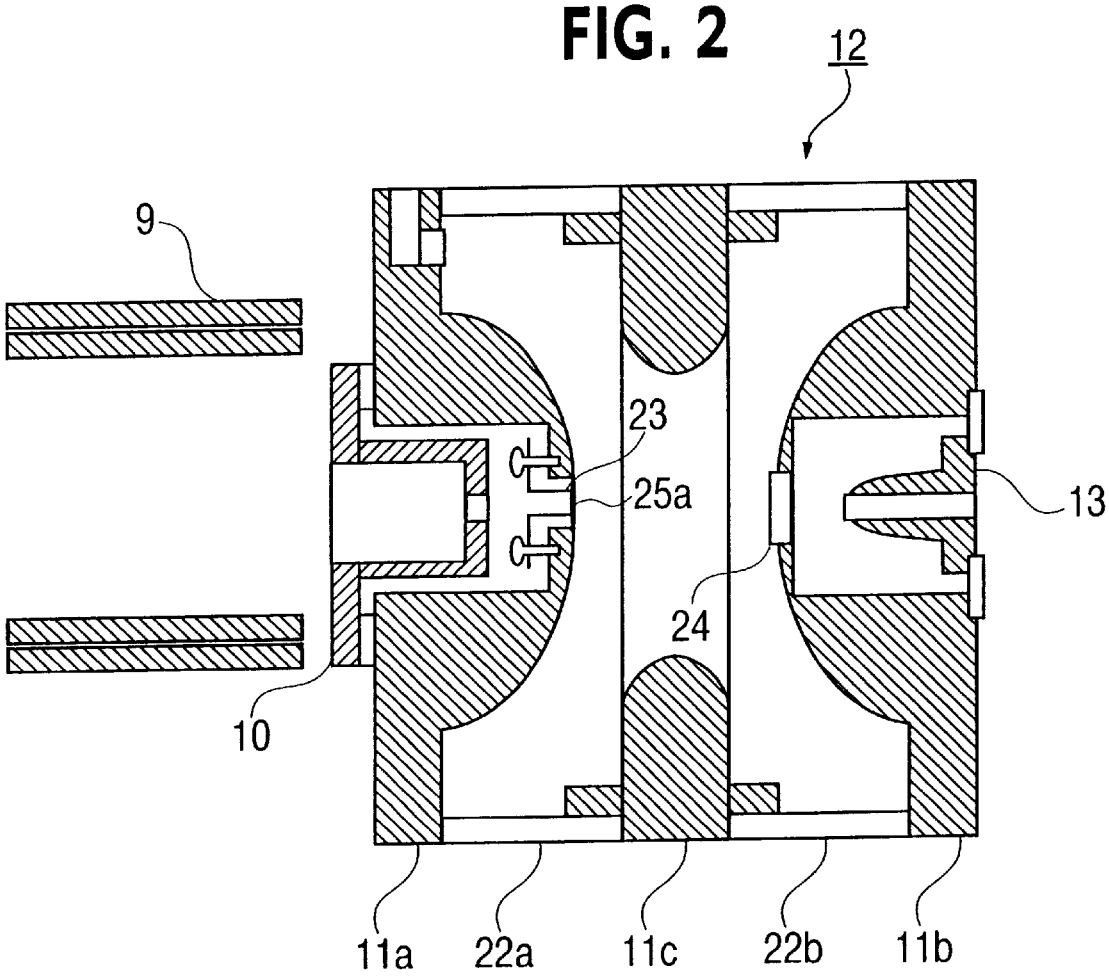
FIG. 2 is a view showing an example of a structure wherein a mesh electrode is fitted to one of endcap electrodes according to the invention.

In the present embodiment, therefore, as shown in FIG. 2, a conductive mesh electrode 25*a*, which is not shown in FIG. 1 for simplicity, is fitted to the ion sampling aperture 23 of the endcap electrode 11*a*. By fitting the mesh electrode 25*a*, the adverse effect on the radio frequency electric field in the mass analysis region 12 by making the diameter of the ion sampling aperture 23 as described above larger is effectively suppressed. The aforementioned deterioration in resolution is prevented.

Figure 3A:
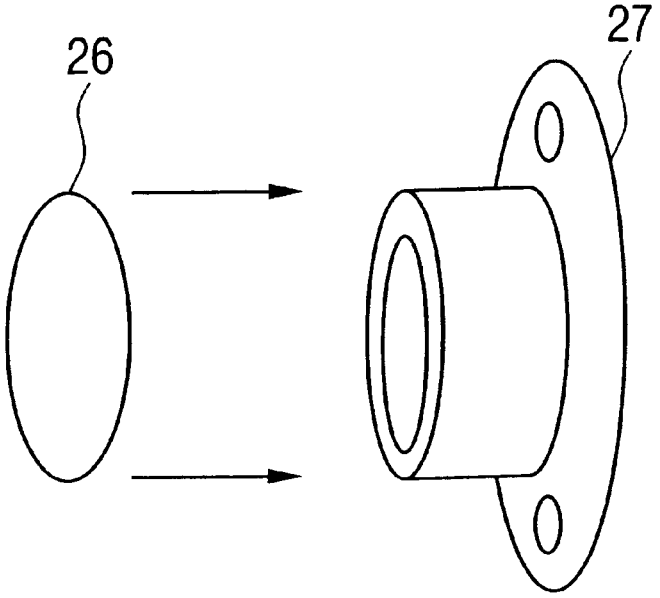
FIGS. 3(*a*) and 3(*b*) are views showing a specific example of a structure of a mesh electrode in the invention.
Figure 3B:
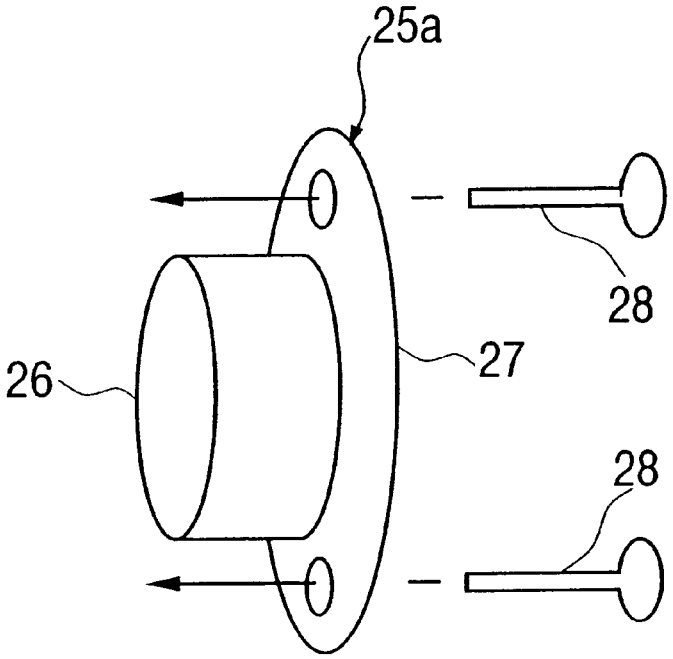

It is necessary that a mesh-fitting position of the mesh electrode 25*a* (a mesh face) is consistent with the end face, at the side opposite to ring electrode 11*c* of the endcap electrode 11*a*. In reality the end face of the endcap electrode 11*a* is a hyperboloid. However, the mesh face is not necessarily made into a hyperboloid. A substantially flat mesh face can approximate to the hyperboloid mesh face. Adverse effect on the radio frequency electric field in the mass analysis region 12 by approximation to the substantially flat face can almost be ignored. In the present embodiment, as the mesh electrode 25*a* an electrode having a structure shown in FIG. 3 is used. Specifically, as shown in FIG. 3(*a*), a flat mesh 26 made of a stainless steel is spot-welded to the end face of a cylindrical electrode 27. This is inserted into the ion sampling aperture 23, and then is fixed to the endcap electrode 11*a* with screws 28, as shown in FIG. 3(*b*).

Figure 5:
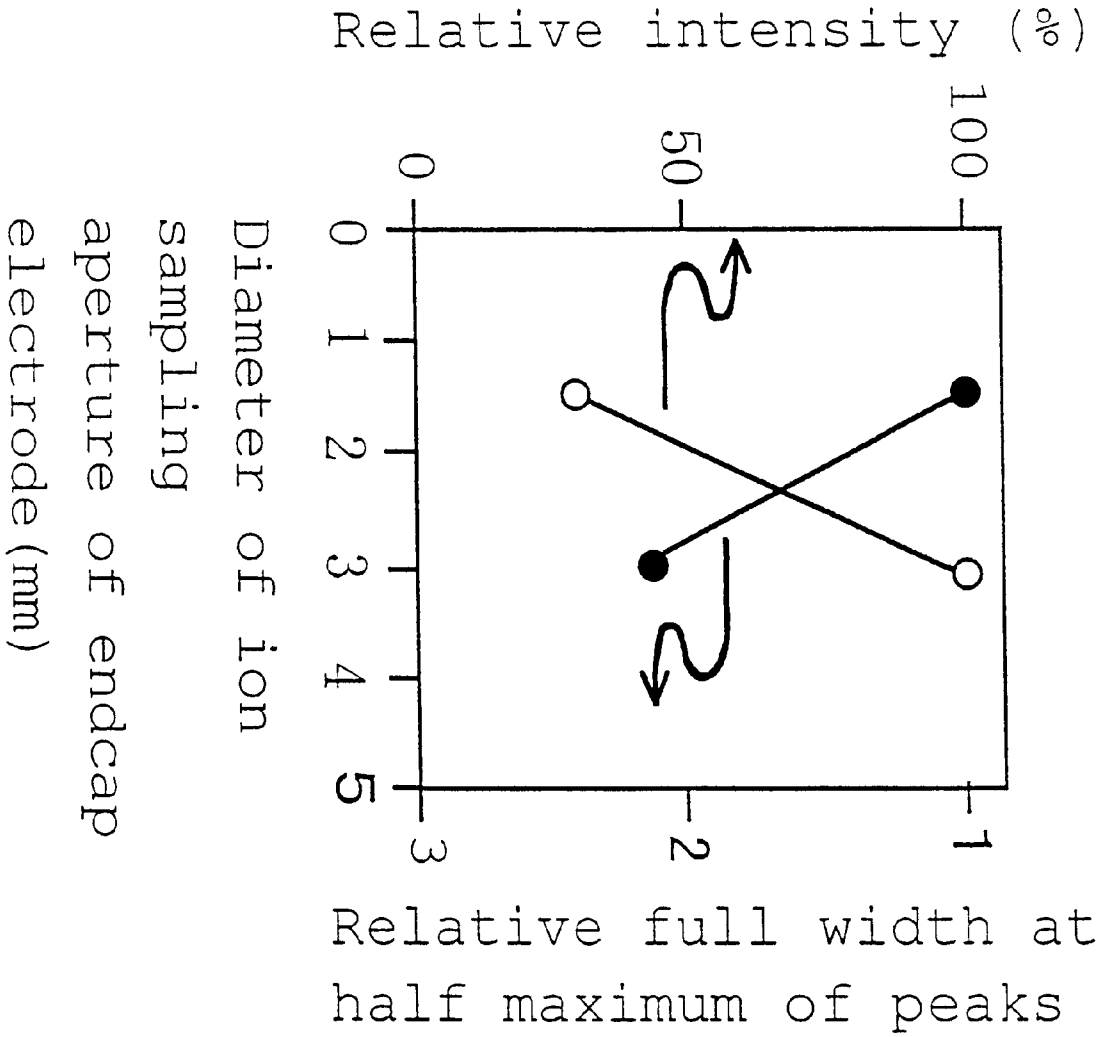
FIG. 5 is a view for explaining an influence by the diameter of an ion sampling aperture.

FIG. 5 shows dependency of relative ion intensity and full width at half maximum of ion intensity peaks observed in a mass spectrum on the diameter of the ion sampling aperture 23 of the endcap 11*a*, when the mesh electrode 25*a* is not fitted. As is evident from FIG. 5, when the diameter of the ion sampling aperture 23 is 3 mm, the relative ion intensity (while dots in FIG. 5) is about 3 times as large as when it is 1.3 mm. However, the full width at half maximum (black dots) of the ion intensity peaks is 2 times or more as large as when it is 1.3 mm. That is, the peaks of the ion are made broad.

Figure 4A:
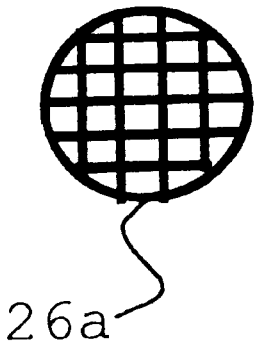
FIGS. 4(*a*), 4(*b*) and 4(*c*) are views showing an example of a mesh structure of a mesh electrode in the invention.
Figure 4B:
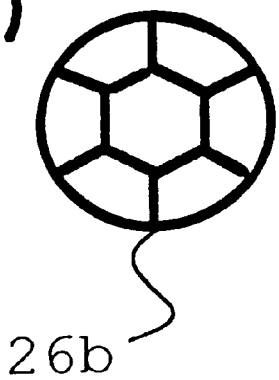
Figure 4C:
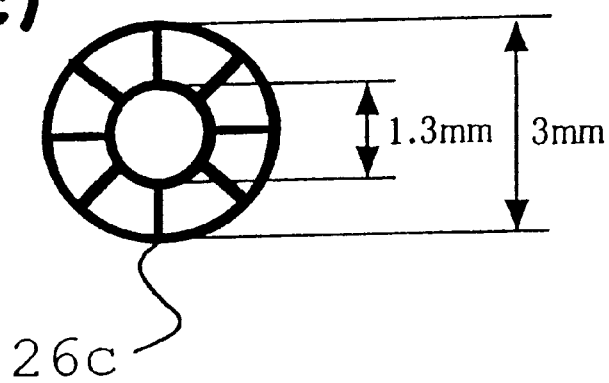

In case the mesh electrode 25*a* having the mesh 26*b* of a shape shown in FIG. 4(*b*) is fitted to the ion sampling aperture 23 in the endcap electrode 11*a* (aperture diameter: 3 mm), the relative ion intensity is as high as when the mesh electrode 25*a* is not fitted and the aperture diameter is 3 mm. However, the full width at half maximum of the ion peaks is as small as when the mesh electrode 25*a* is not fitted and the aperture diameter is 1.3 mm. In short, even if the diameter of the ion sampling aperture 23 is made large up to 3 mm, by fitting the mesh electrode 25*a* it is possible to keep an ion intensity level in the case where the mesh electrode 25*a* is not fitted and the aperture diameter is 3 mm and simultaneously make the full width at half maximum of the ion intensity peaks into the same level as that in the case where the mesh electrode 25*a* is not fitted and the aperture diameter is 1.3 mm, and that sufficient detection sensitivity and necessary resolution can be obtained together.

Figure 6:
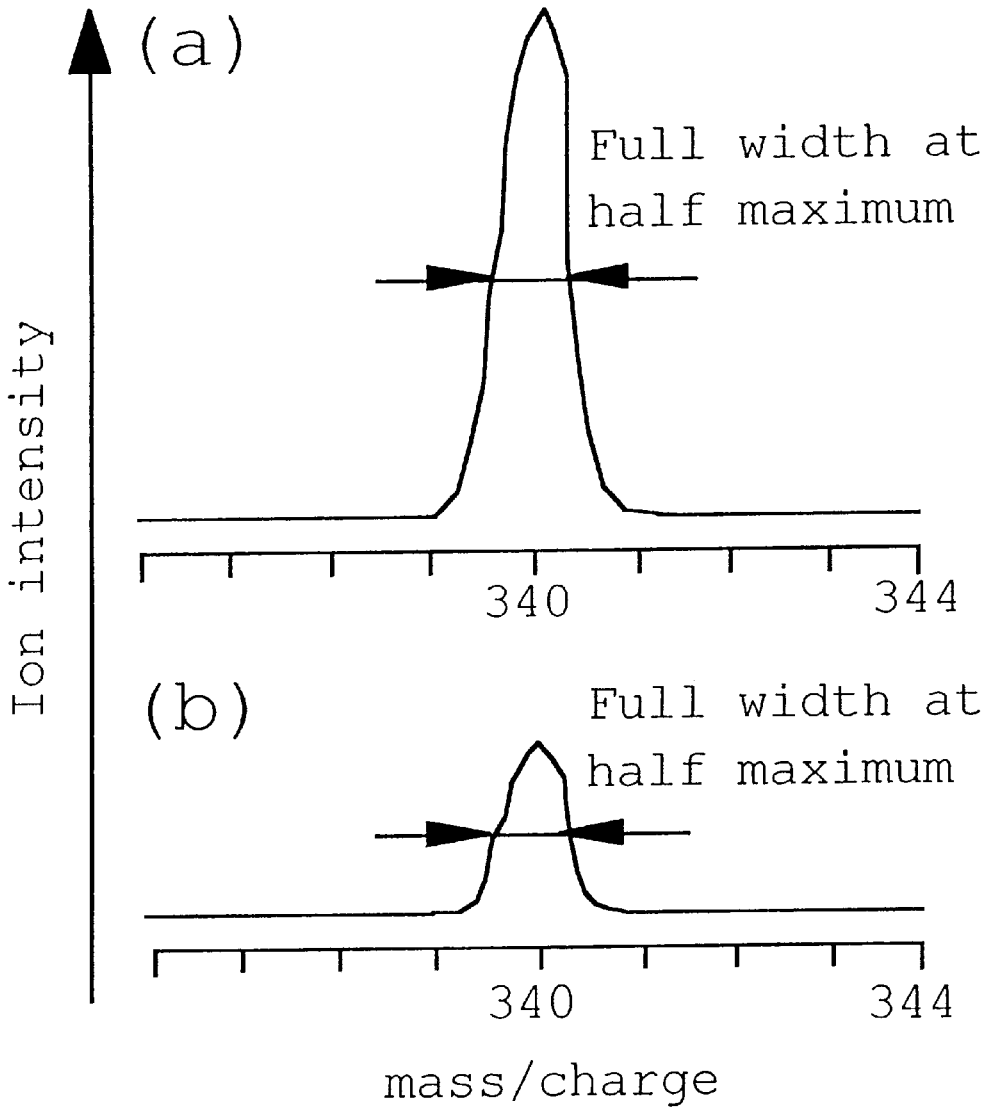
FIG. 6 is a view for explaining advantages of setting up a mesh electrode according to the invention.

In FIGS. 6(*a*) and (*b*) show an ion peak obtained when the diameter of the ion sampling aperture 23 is 3 mm and the mesh electrode 25*a* is fitted, and an ion peak obtained when the diameter of the ion sampling aperture 23 is 1.3 mm and the mesh electrode 25*a* is not fitted, respectively. As is clear from FIGS. 6(*a*) and (*b*), in both the cases, the full width at half maximum is substantially the same, but the ion intensity in the case where the mesh electrode 25*a* is fitted is about 3 times as large as when it is not fitted. Thus, it can be understood that the present invention is very effective for improvement in detection sensitivity. In the present embodiment, an electrospray method is used as the ionizing method. Tetraphenylphosphonium chloride (molecular weight: 340), and water/methanol/acetic acid (v/v: 50/49/1) are used as the sample and the solvent, respectively. The flow rate of the solvent is 50 $\mu$l/minute.

Figure 7:
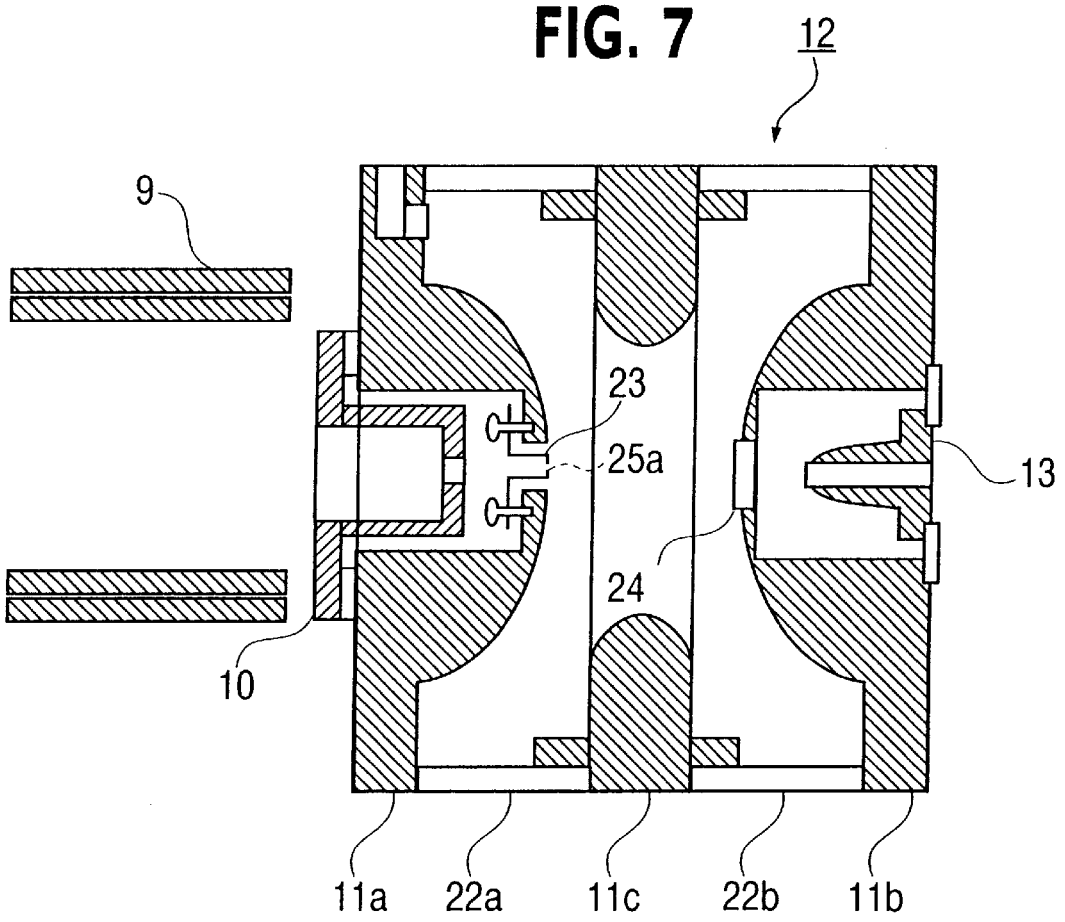
FIG. 7 is a view showing an example of a structure wherein mesh electrodes are fitted to both endcap electrodes, respectively, according to the invention.

In the embodiment shown in FIG. 2, the mesh electrode 25*a* is arranged to only the side of the ion sampling aperture 23 of the endcap electrode 11*a*. However, as shown in FIG. 7, a mesh electrode 25*b* may be arranged to the side of the ion extracting aperture 24 of the endcap electrode 11*b*, as well, in order to obtain better effects based on improvement in detection sensitivity.

In the embodiment, the ions introduced from the differential pumping region into the vacuum chamber 31 through the skimmer 5 are deflected with the deflector 9 and then are introduced into the ion trap mass analysis region 12. Of course, however, when the ions are introduced thereto without being deflected, substantially the same advantages can be obtained.

Embodiment 2

Figure 8:
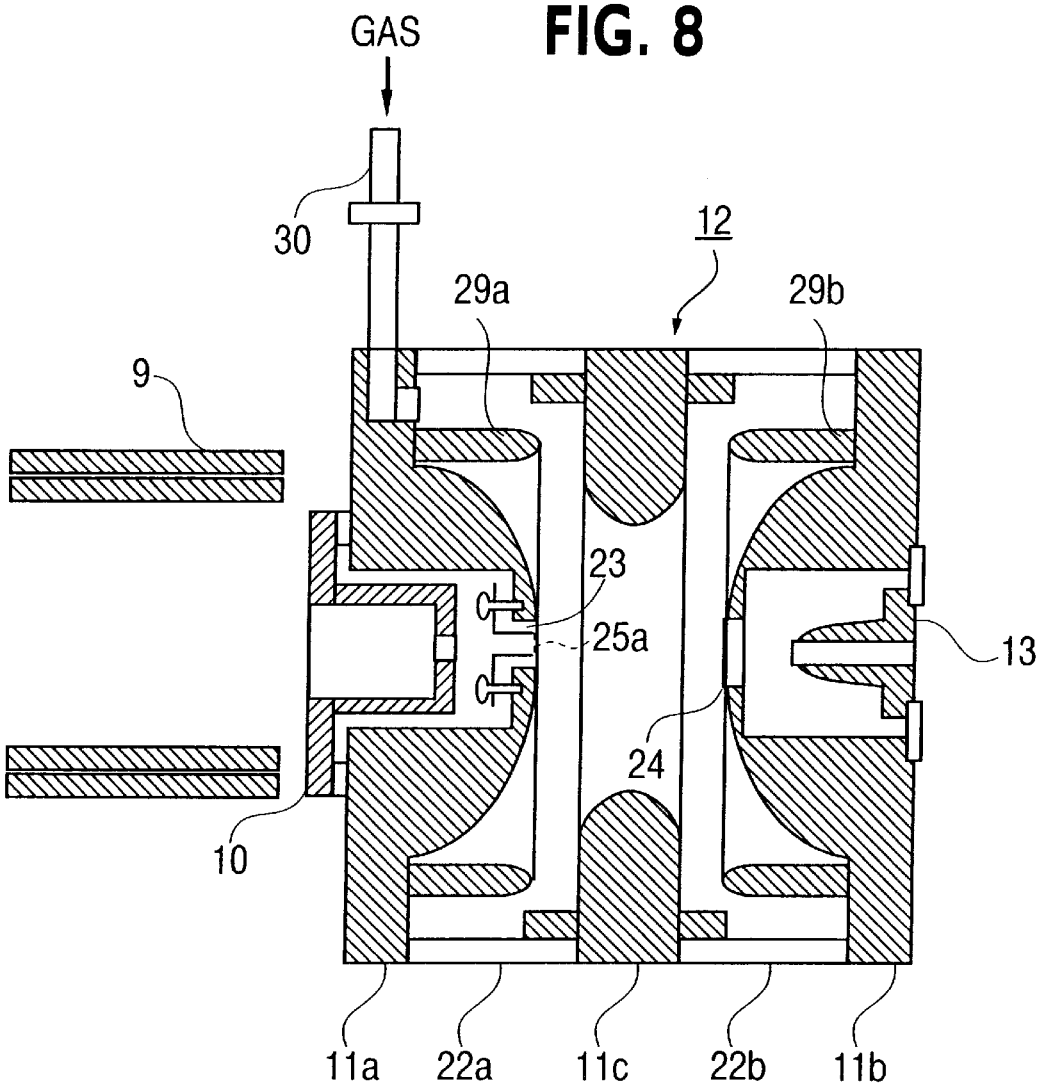
FIG. 8 is a view schematically showing a mass analysis region in an ion trap mass spectrometer according to a second embodiment of the present invention.

FIG. 8 is a view schematically showing a structure of an ion trap mass spectrometer according to a second embodiment of the present invention. The present embodiment is an embodiment wherein a shield electrode is arranged between endcap electrodes and a ring electrode to prevent charging up of an insulated ring caused by a part of ions introduced into a mass analysis region, and occurrence of evils based on the charging up.

As described above, when analysis is carried out by using the spectrometer shown in FIG. 1, the following problems may occur. That is, when ions are introduced into the ion trap mass analysis region 12 surrounded by the endcap electrode 11*a* and 11*b*, and the ring electrode 11*c*, a part of the introduced ions collides with inner walls of the insulated rings 22*a* and 22*b*. The insulated rings 22*a* and 22*b* are charged up to have an adverse effect on the trajectory of the ions trapped inside the ion trap mass analysis region 12. Thus, the extracting efficiency of the ions from the mass analysis region 12 deteriorates, so that observed ion intensity may decrease sharply.

As shown in FIG. 8, however, in the present embodiment, since shield electrodes 29*a* and 29*b* are provided which extend from endcap electrodes 11*a* and 11*b* toward the side of a ring electrode 11*c*, substantially in parallel to the inner walls of the insulated rings 22*a* and 22*b*, and apart from the inner walls at a given distance, charged particles such as ions approaching the inner walls of the insulated rings 22*a* and 22*b* are shut out by these shield electrodes 29*a* and 29*b*, so that charging up of the insulated rings 22*a* and 22*b* is effectively prevented.

Figure 9A:
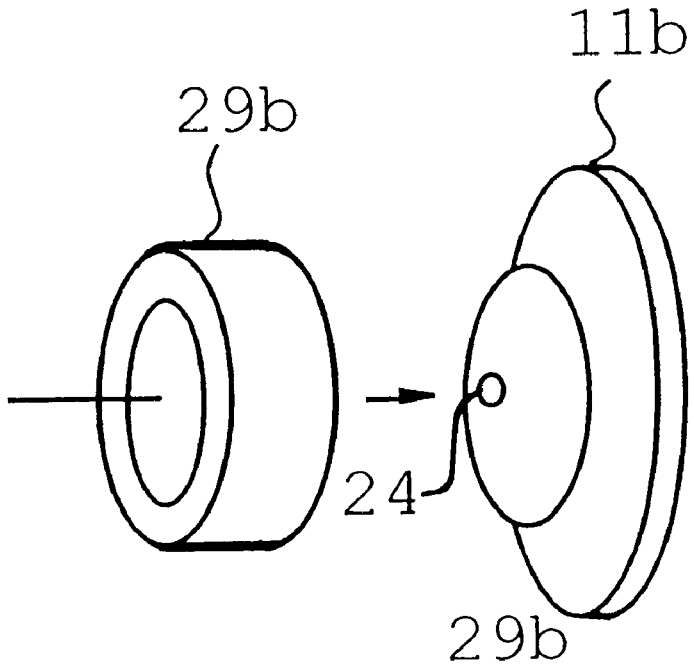
FIGS. 9(*a*) and 9(*b*) are views showing an example of a structure wherein a shield electrode is fitted into a mass analysis region in the invention.
Figure 9B:
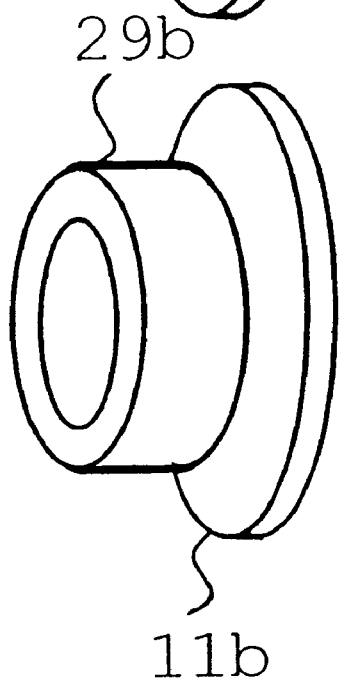

As shown in FIG. 9, in the present embodiment the shield electrode 29 in a ring form is concentrically fitted to the endcap electrode 11*b* having an ion sampling aperture 24. This is the same as for the shield electrode 29*a* and the endcap electrode 11*a*. Even if the insulated rings 22*a* and 22*b* are charged up to some extent by a slight part of ions introduced into the ion trap mass analysis region 12, there is not any fear, because of the existence of the shield electrodes 29*a* and 29*b*, that the slight charging up has a great influence on the central portion of the ion trap mass analysis region 12 on which the ions are trapped.

A radio frequency potential over 10 kV at peak to peak is applied to the ring electrode 11*c*. In order to prevent charging, therefore, it is desirable to make the tip portions of the shield electrodes 29*a* and 29*b* (the tip portions at the side of the ring electrodes) round. To trap ions introduced into the mass analysis region 12, a gas introducing path 30 for buffer gas introduced into the region 12 is disposed at the side of the endcap electrode 11*a*. Therefore, the shield electrode 22*a* at the side of the gas introducing path 30 also has a function of rectifying a deflected stream of introduced gas to keep gas pressure inside the ion trap mass analysis region 12 constant.

Figure 10:
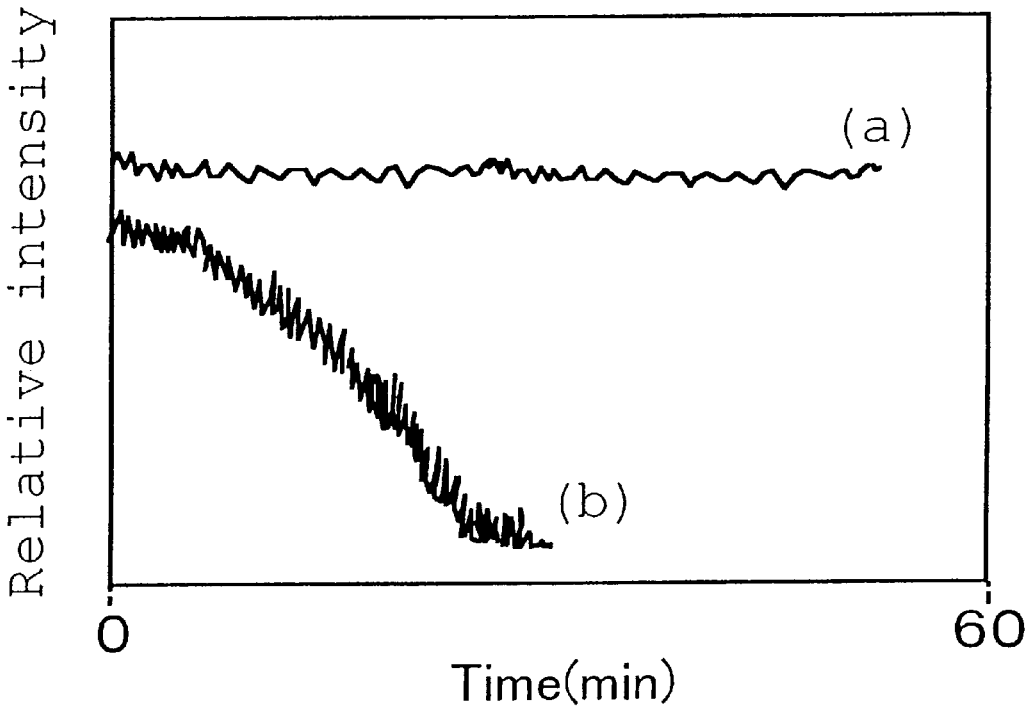
FIG. 10 is a view for explaining advantages of setting up the shield electrode according to the invention.

FIG. 10 is a view showing change over time in ion intensity of ions taken out from the ion trap mass analysis region 12 and observed. In FIG. 10, lines (a) and (b) show the cases if the shield electrodes 29*a* and 29*b* are fitted, and if they are not fitted, respectively. As is clear from FIG. 10, the relative ion intensity sharply decreases with the passage of time when the shield electrodes 29*a* and 29*b* are not fitted, but the ion intensity is kept stable for a long time when the shield electrodes 29*a* and 29*b* are fitted. This demonstrates that the advantageous effect of the present invention is remarkable. In the present embodiment, an electrospray method is used as the ionizing method. Tetraphenylphosphonium chloride (molecular weight: 340), and water/methanol/acetic acid (v/v: 50/49/1) are used as the sample and the solvent, respectively. The flow rate of the solvent is 50 $\mu$l/minute.

In the embodiment, the ions introduced from the differential pumping region into the vacuum chamber 31 through the skimmer 5 is deflected with the deflector 9 and then are introduced into the ion trap mass analysis region 12. Of course, however, if the ions are introduced thereto without being deflected, substantially the same advantages can be obtained.

Embodiment 3

Figure 11:
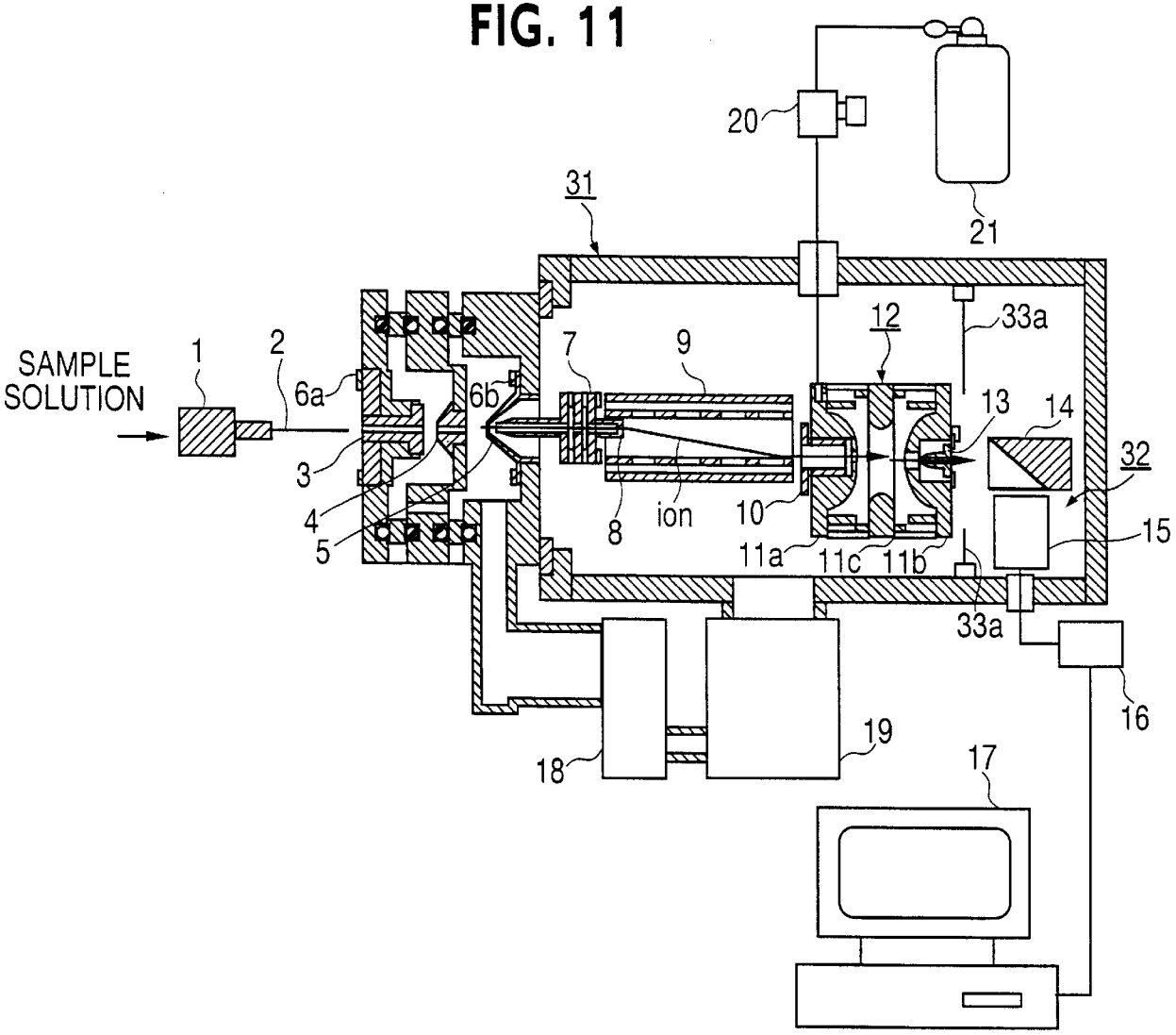
FIG. 11 is a view schematically showing a structure of an ion trap mass spectrometer according to a third embodiment of the present invention.
Figure 15:
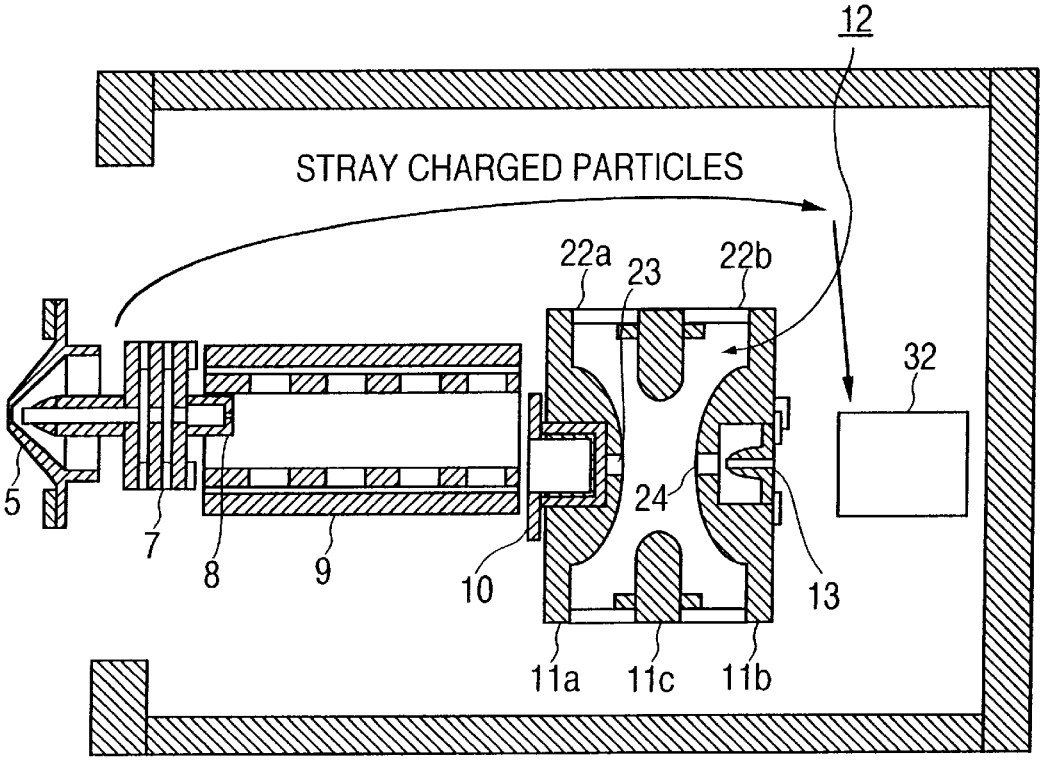
FIG. 15 (PRIOR ART)
FIG. 15 is a view for explaining various problems in the conventional ion trap mass spectrometer.

FIG. 11 is a view schematically showing a structure of an ion trap mass spectrometer according to a third embodiment of the present invention. The present embodiment is an embodiment wherein a shield member for shielding, in the middle of a detour path, stray charged particles (ions or charged droplets) which detour through the outside of the ion trap mass analysis region to reach the ion detecting region, as described referring to FIG. 15, is fitted so as to decrease noises.

As described above, a problem caused by carrying out actual analysis using the spectrometer shown in FIG. 1 is that a part of charged particles, such as ions, which are generated in the ion source 1 under atmospheric pressure and then flow from the skimmer 5 into the vacuum chamber 31 through the differential pumping region makes a detour through the circumference of the mass analysis region 12 to reach the ion detecting region 32. Consequently, noises are generated. Since a high potential of several kV is usually applied to the ion detecting region 32, the stray charged particles detouring through the circumference of the mass analysis region 12 are accelerated by the applied high potential, so that the particles are made incident on the ion detecting region 32. Thus, random noises are detected, resulting in decrease in the S/N ratio of detection signals.

As shown in FIG. 11, however, according to the present embodiment, in the vicinity of the end portion, at the side of the ion detecting region, of a mass analysis region 12 inside a vacuum chamber 31, a conductive shield member 33*a* for shielding stray charged particles detouring through the circumference of the mass analysis 12 is arranged in a ring form around the mass analysis region 12. For this reason, the stray charged particles collide with the shield member 33*a* and become extinct through steps of neutrality and the like, so that they cannot reach the ion detecting region 32. Thus, the decrease in the S/N ratio of detection signals based on increase in random noises is effectively prevented. In the present embodiment, as the shield member 33*a*, a ring-like stainless steel plate material having an opening at the center thereof and having a mesh structure is used. The plate shield member having a mesh structure is manufactured by applying a well-known chemical etching method to a stainless steel to be processed into a mesh form.

Figure 12:
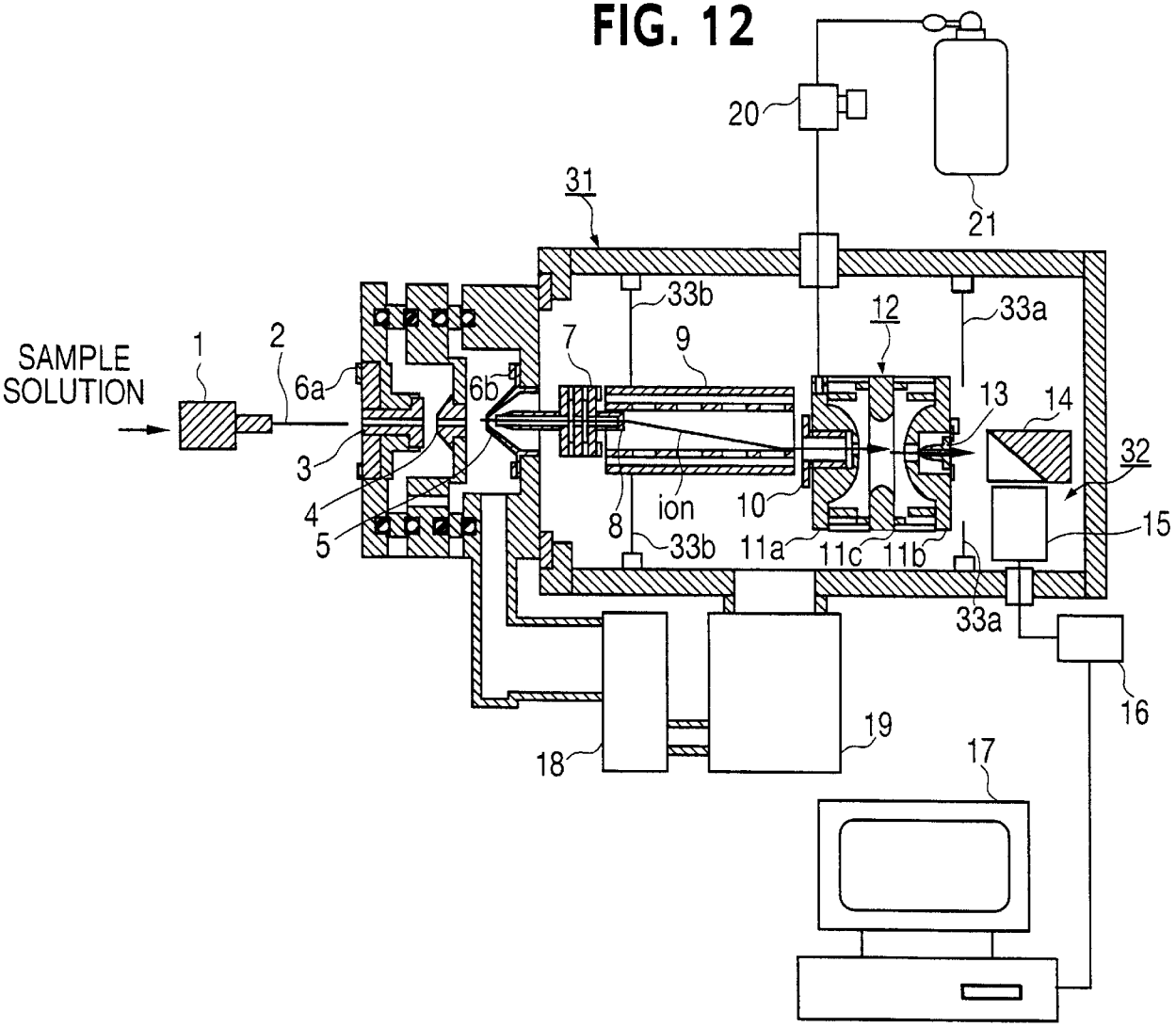
FIG. 12 is a view showing a modified example of the ion trap mass spectrometer according to the third embodiment of the present invention.

FIG. 11 illustrates a case in which the shield member 33 is arranged near the end portion at the ion detecting region side of the mass analysis region 12. As shown in FIG. 12, however, a plurality of shield members 33*a* and 33*b* may be arranged. In FIG. 12, the shield member 33*a* is arranged near the end portion at the ion detecting region side of the mass analysis region 12, and the shield member 33*b* is arranged around a deflector 9. By arranging the plural shield members in such a manner, the effect of shielding the stray charged particles can be improved still more.

Figure 13:
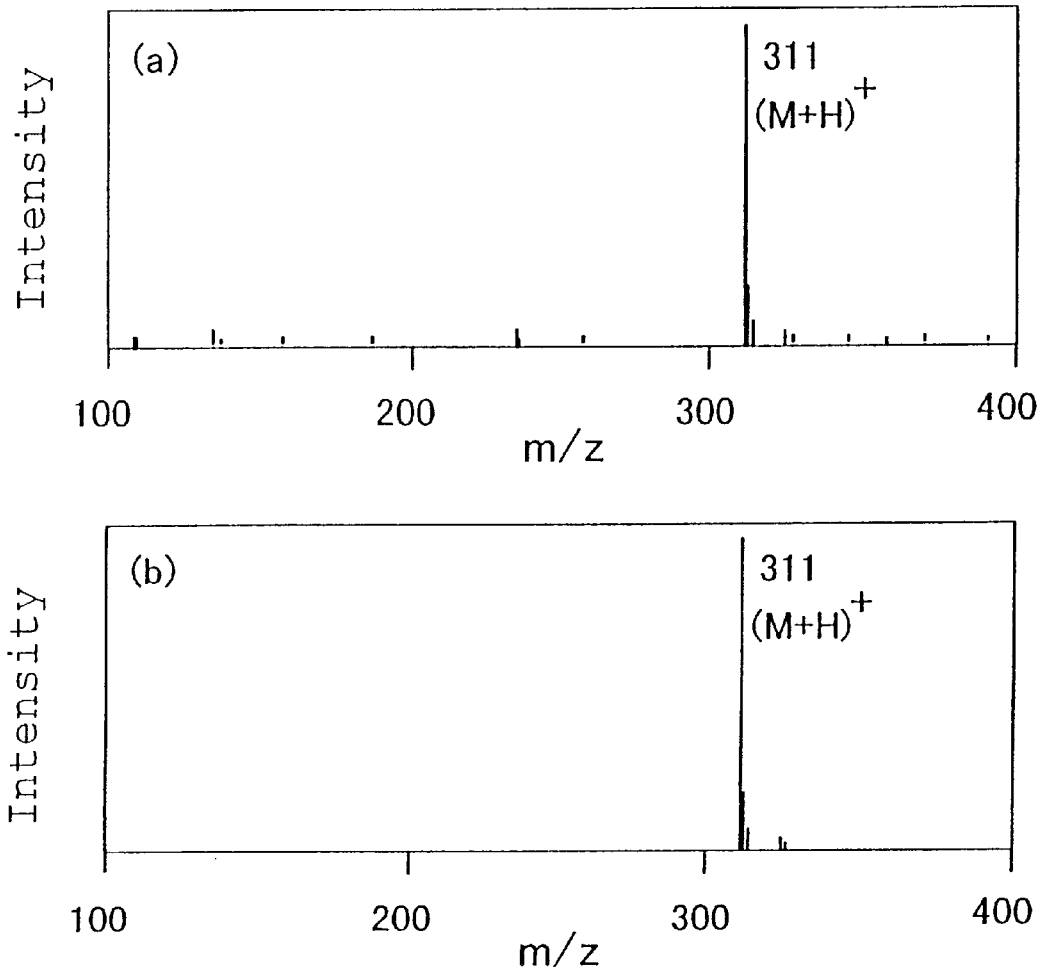
FIG. 13 is a view for explaining advantages of setting up a shield member according to the invention.
Figure 13:
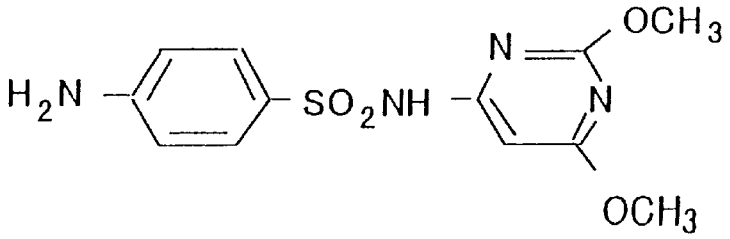
Figure 14:
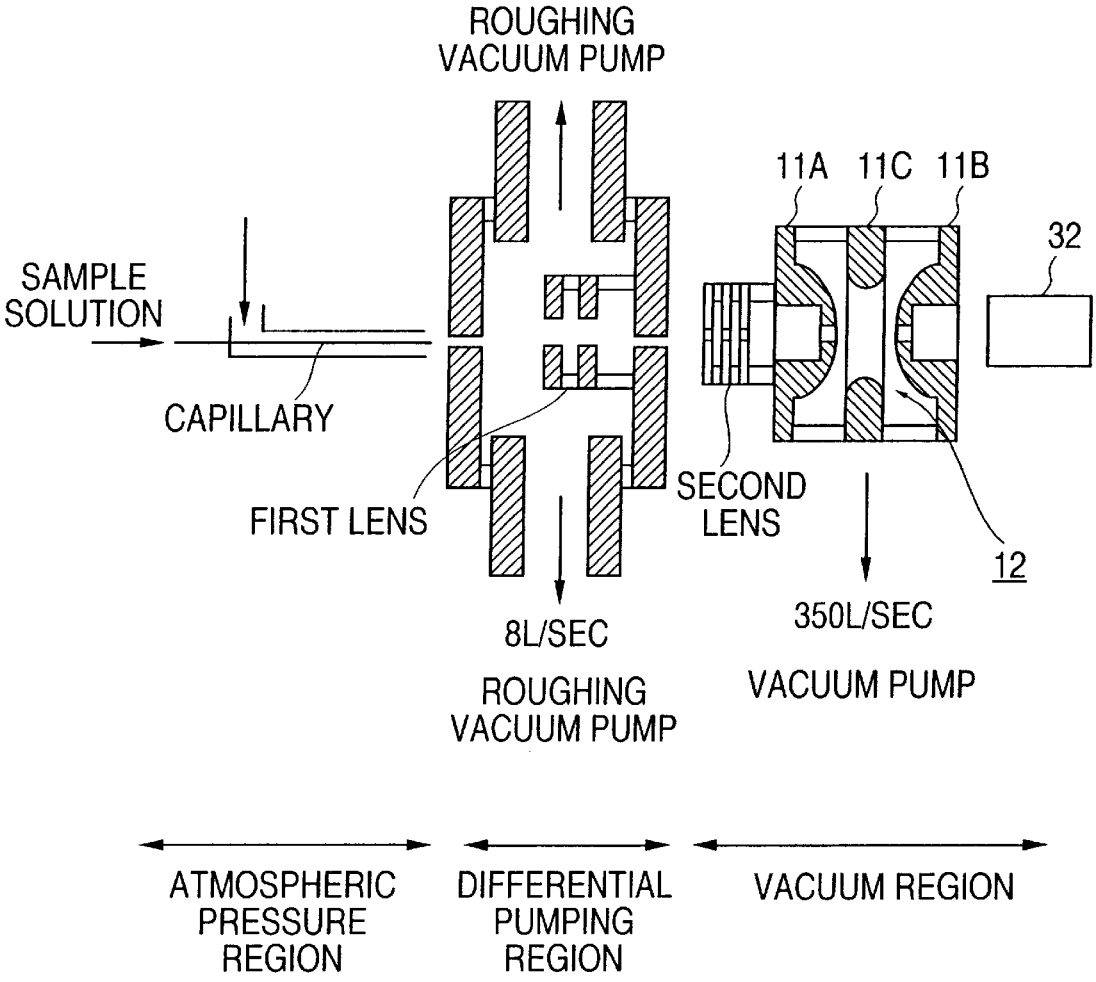
FIG. 14 (PRIOR ART)
FIG. 14 is a view showing an example of a structure of a conventional ion trap mass spectrometer.

The advantageous effect obtained by arranging the shield member will be specifically described, referring to FIG. 13. FIGS. 13(*a*) and (*b*) show mass spectra obtained by means of a spectrometer to which the shield members are not fitted, and a spectrometer of the present invention to which the shield member 33*a* as shown in FIG. 11 is fitted, respectively. In these cases, as an ionizing method, an atmospheric pressure chemical ionization method is used. Sulfurdimethoxyn and water/methanol (v/v: 50/50) are used as the sample and the solvent, respectively. The flow rate of the solvent is 1 ml/minute. A high peak observed at the place where the mass to charge ratio (m/e ratio) is 311 is concerned with the molecular ion $(M+H)^+$ of the sample molecule. As is clear from FIG. 13, signal intensity based of the molecular ion is hardly different in both the cases. But random noises other than the detection signal from the molecular ion are reduced to a larger extent when the shield member is used, shown in FIG. 13(*b*), than when the shield member is not used, shown in FIG. 13(*a*). It is confirmed that fitting the shield member according to the present invention is effective.

As described in detail above, it is clear that according to the ion trap mass spectrometer of the present invention a high analysis sensitivity can be obtained without any drop in resolution.

What is claimed is:

1. An ion trap mass spectrometer comprising an ion source for generating ions of sample molecules under an atmospheric pressure; a vacuum region which is evacuated to make a sufficient vacuum; a differential pumping region disposed in the middle of a path of the ions for sampling the ions generated by the ion source into the vacuum region; a focusing lens set inside the vacuum region for focusing the ions sampled into the vacuum region through the differential pumping region; a mass analysis region having a pair of endcap electrodes opposite to each other inside the vacuum region and a ring electrode arranged between the endcap electrodes, the mass analysis region being for mass-analyzing the ions focused by the focusing lens; and an ion detector for detecting the mass-analyzed ions, wherein a conductive mesh electrode is fitted to an end face at the side opposite to the ring electrode of an aperture made in the the endcap electrode arranged at the side of the focusing lens.

2. The ion trap mass spectrometer according to claim 1, wherein another conductive mesh electrode is fitted to an end face at the side opposite to the ring electrode of an aperture made in the endcap electrode arranged at the side of the ion detector.

3. The ion trap mass spectrometer according to any one of claims 1 and 2, wherein the conductive mesh electrode is an electrode in which a mesh aperture is made on the central axis of the aperture.

4. The ion trap mass spectrometer according to any one of claims 1 and 2, wherein the conductive mesh electrode is an electrode in which a conductive mesh is supported on either of aperture ends of a cylindrical electrode.

5. The ion trap mass spectrometer according to claim 1, wherein at the inside of an inner wall face of an insulated ring made of an insulating material and disposed between the pair of the endcap electrodes and the ring electrode, a shield electrode for shielding the ions approaching the inner wall face of the insulated ring is further arranged.

6. The ion trap mass spectrometer according to claim 5, wherein the shield electrode is electrically connected to the endcap electrode at the side where the shield electrode is arranged.

7. The ion trap mass spectrometer according to claim 5 or 6, wherein the shield electrode is formed into a ring form, and is arranged concentrically with the aperture made in the endcap electrode.

8. The ion trap mass spectrometer according to any one of claims 5 and 6, wherein the end face, at the side opposite to the ring electrode, of the shield electrode is made round.

9. The ion trap mass spectrometer according to claim 1 or 5, wherein in the middle of a path of the ions reaching the ion detector through the circumference of the mass analysis region in the vacuum region, a shield member for shielding the ions approaching the ion detector through the path is further arranged.

10. The ion trap mass spectrometer according to claim 9, wherein the shield member is arranged in at least one of the vicinities of an end portion at an ion extracting side of the mass analysis region and an end portion at an ion sampling side thereof, so as to shield the ions approaching the ion detector.

11. The ion trap mass spectrometer according to claim 9, wherein a plurality of the shield members are arranged in the middle of the path.

12. The ion trap mass spectrometer according to claim 11, wherein at least one of the plural shield members is arranged in the vicinity of the end portion at the ion extracting side of the mass analysis region.

13. The ion trap mass spectrometer according to of claim 9, wherein the shield member is a member in a form of a plate having many openings.

14. The ion trap mass spectrometer according to of claim 9, wherein the shield member is a member in a form of a baffle in which plural rectangular plate members are arranged.

15. The ion trap mass spectrometer according to claim 1, wherein a deflector for deflecting the ions is further arranged between the focusing lens and the mass analysis region.

16. An ion trap mass spectrometer comprising an ion source for generating ions of sample molecules under atmospheric pressure; a vacuum region which is evacuated to make a sufficient vacuum; a differential pumping region disposed in the middle of a path of the ions for sampling the ions generated by the ion source into the vacuum region; a focusing lens set inside the vacuum region for focusing the ions sampled into the vacuum region through the differential pumping region; a mass analysis region having a pair of endcap electrodes opposite to each other inside the vacuum region and a ring electrode arranged between the endcap electrodes, the mass analysis region being for mass-analyzing the ions focused by the focusing lens; and an ion detector for detecting the mass-analyzed ions, wherein a shield electrode is further arranged at the inside of an inner wall face of an insulated ring made of an insulating material and disposed between the pair of the endcap electrodes and the ring electrode, the shield member being for shielding the ions approaching the inner wall face of the insulated ring.

17. The ion trap mass spectrometer according to claim 16, wherein in the middle of a path of the ions reaching the ion detector through the circumference of the mass analysis region in the vacuum region, a shield member for shielding the ions approaching the ion detector through the path is further arranged.

18. An ion trap mass spectrometer comprising an ion source for generating ions of sample molecules under atmospheric pressure; a vacuum region which is evacuated to make a sufficient vacuum; a differential pumping region disposed in the middle of a path of the ions for sampling the ions generated by the ion source into the vacuum region; a focusing lens set inside the vacuum region for focusing the ions sampled into the vacuum region through the differential pumping region; a mass analysis region having a pair of endcap electrodes opposite to each other inside the vacuum region and a ring electrode arranged between the endcap electrodes, the mass analysis region being for mass-analyzing the ions focused by the focusing lens; and an ion detector for detecting the mass-analyzed ions, wherein a shield member is further arranged in the middle of a path of the ions reaching the ion detector through the circumference of the mass analysis region in the vacuum region, the shield member being for shielding the ions approaching the ion detector through the path.

19. An ion trap mass spectrometer comprising:

an ion source for generating ions of samples under an substantially atmospheric pressure;

a vacuum region;

a differential pumping region disposed between the ion source and the vacuum region;

a mass analysis region located in the vacuum region having a pair of endcap electrodes and a ring electrode arranged between the pair of the endcap electrodes; and an ion detector for detecting the mass analyzed ions;

wherein a conductive mesh electrode is further fitted to an end face at the side opposite to the ring electrode of an aperture provided in the endcap electrode arranged at the side of the differential pumping region.

20. An ion trap mass spectrometer comprising:

an ion source for generating ions of samples under an substantially atmospheric pressure;

a vacuum region;

a differential pumping region disposed between the ion source and the vacuum region;

a mass analysis region located in the vacuum region having a pair of endcap electrodes and a ring electrode arranged between the pair of the endcap electrodes;

an insulator ring disposed between the endcap electrodes and the ring electrode; and an ion detector for detecting the mass analyzed ions;

wherein a shield electrode is arranged at the inside of an inner wall face of the insulator ring.

21. An ion trap mass spectrometer comprising:

an ion source for generating ions of samples under an substantially atmospheric pressure;

a vacuum region;

a differential pumping region disposed between the ion source and the vacuum region;

a mass analysis region located in the vacuum region having a pair of endcap electrodes and a ring electrode arranged between the pair of the endcap electrodes; and an ion detector for detecting the mass analyzed ions;

wherein a shield member is arranged outside of the mass analysis region.

* * * * *